US009841726B2

(12) United States Patent
Tokoro

(10) Patent No.: US 9,841,726 B2
(45) Date of Patent: Dec. 12, 2017

(54) IMAGE FORMING APPARATUS

(71) Applicant: KYOCERA Document Solutions Inc., Osaka (JP)

(72) Inventor: Yoshitaka Tokoro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/489,370

(22) Filed: Apr. 17, 2017

(65) Prior Publication Data

US 2017/0300003 A1 Oct. 19, 2017

(30) Foreign Application Priority Data

Apr. 18, 2016 (JP) ..... 2016-082610

(51) Int. Cl.
*G03G 15/08* (2006.01)
*G03G 21/16* (2006.01)
*G03G 15/16* (2006.01)

(52) U.S. Cl.
CPC ..... *G03G 21/168* (2013.01); *G03G 15/162* (2013.01); *G03G 2215/00966* (2013.01); *G03G 2221/1642* (2013.01); *G03G 2221/1654* (2013.01)

(58) Field of Classification Search
USPC ..... 399/107, 110, 111, 121
See application file for complete search history.

(56) References Cited

U.S. PATENT DOCUMENTS 7,382,999 B2 * 6/2008 Takahashi ..... G03G 21/1647 399/110
7,609,997 B2 * 10/2009 Otake ..... G03G 21/1623 399/121
9,182,736 B2 * 11/2015 Ju ..... G03G 21/1623
9,217,987 B2 * 12/2015 Masuda ..... G03G 21/1647
2006/0062593 A1 * 3/2006 Takahashi ..... G03G 21/1638 399/121

FOREIGN PATENT DOCUMENTS

JP 2000-147977 A 5/2000
JP 2004-272296 A 9/2004

* cited by examiner

*Primary Examiner* — Hoan Tran
(74) *Attorney, Agent, or Firm* — Stein IP, LLC

(57) ABSTRACT

An image forming apparatus includes a unit horizontally insertable and drawable with respect to a main body frame, and a lock mechanism for the unit. The lock mechanism includes a lock member which has an engagement projection engageable with an engaged portion formed in the main body frame, and a biasing member which biases the lock member in a first direction toward engagement of the engagement projection with the engaged portion. Along with insertion of the unit, the lock member moves in a second direction, and when the unit is inserted to a predetermined position, biasing force of the biasing member causes the lock member to move in the first direction and the engagement projection engages with the engaged portion. By moving the lock member in the second direction, engagement between the engagement projection and the engaged portion is released to make it possible to draw the unit.

7 Claims, 8 Drawing Sheets

IMAGE FORMING APPARATUS

INCORPORATION BY REFERENCE

This application is based upon and claims the benefit of priority from the corresponding Japanese Patent Application No. 2016-082610 filed on Apr. 18, 2016, the entire contents of which are incorporated herein by reference.

BACKGROUND

The present disclosure relates to an image forming apparatus including a unit, such as an intermediate transfer unit, which is horizontally attachable and detachable with respect to an apparatus main body.

Various image forming apparatuses have conventionally been proposed, among which there are ones that adopt an intermediate transfer method and include an endless-shaped intermediate transfer belt configured to rotate in a predetermined direction and a plurality of image forming portions arranged along the intermediate transfer belt, the image forming portions configured to form toner images, which are sequentially transferred onto the intermediate transfer belt to be superimposed one on another, to be then transferred altogether onto a recording medium.

In the image forming apparatuses adopting the intermediate transfer method as described above, the intermediate transfer belt needs to be replaced regularly, because its life is shorter than the life of the apparatus main body. For example, there is known an image forming apparatus which has an intermediate transfer unit that is drawable in the horizontal direction from the main body of the image forming apparatus.

SUMMARY

According to an aspect of the present disclosure, an image forming apparatus includes a unit and a lock mechanism for the unit. The unit is horizontally insertable and drawable with respect to a main body frame. The lock mechanism includes a lock member and a biasing member. The lock mechanism holds the unit in a state of being mounted in the main body frame, and the lock mechanisms is able to release hold of the unit. The lock member is arranged in the unit to be reciprocatable in a direction perpendicular to an inserting/drawing direction of the unit, and has an engagement projection engageable with an engaged portion formed in the main body frame. The biasing member biases the lock member in a first direction toward engagement of the engagement projection with the engaged portion. Along with insertion of the unit into the main body frame, the lock member moves in a second direction reverse to the first direction against biasing force of the biasing member, and when the unit is inserted to a predetermined position, the lock member is moved by the biasing force of the biasing member in the first direction and the engagement projection engages with the engaged portion. By moving the lock member in the second direction against the biasing force of the biasing member, engagement between the engagement projection and the engaged portion is released to make it possible to draw the unit out of the main body frame.

Further features and specific advantages of the present disclosure will become apparent from the following descriptions of preferred embodiments.

DETAILED DESCRIPTION

Figure 1:
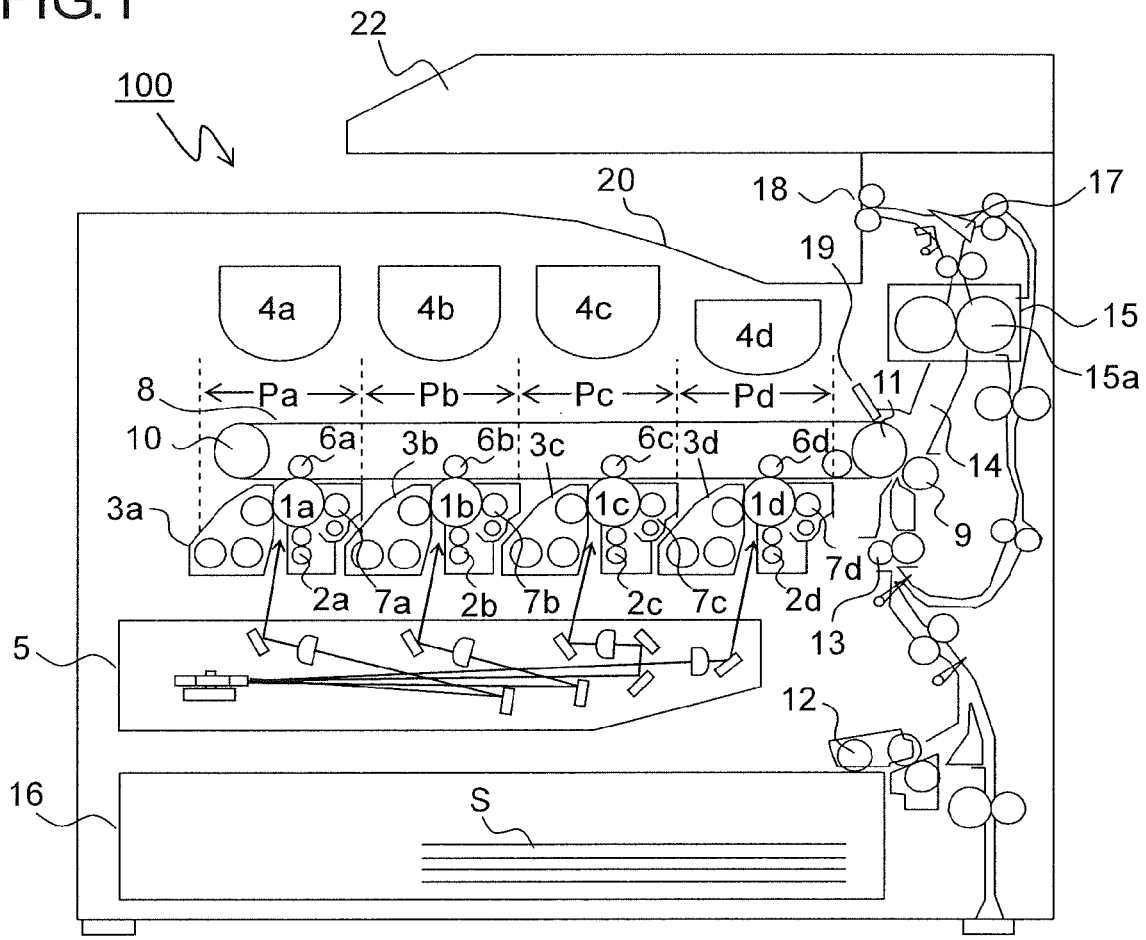
FIG. 1 is a schematic sectional view illustrating an internal configuration of an image forming apparatus according to an embodiment of the present disclosure.

Hereinafter, embodiments of the present disclosure will be described with reference to the accompanying drawings. FIG. 1 is a schematic sectional view of an image forming apparatus according to an embodiment of the present disclosure, and the image forming apparatus shown in the figure is a tandem-type color printer. In a main body of an image forming apparatus 100, image forming portions Pa, Pb, Pc, and Pd are arranged in this order from an upstream side in a conveyance direction (a left side in FIG. 1). The image forming portions Pa to Pd are provided corresponding to images of four different colors (cyan, magenta, yellow, and black), and sequentially form images of cyan, magenta, yellow, and black through charging, exposure, developing, and transfer steps.

The image forming portions Pa, Pb, Pc, and Pd include photosensitive drums 1*a*, 1*b*, 1*c*, and 1*d*, respectively, which carry visible images (toner images) of respective colors. Further, an intermediate transfer belt 8, which is rotated by drive means (unillustrated) in a counterclockwise direction in FIG. 1, is provided adjacent to the image forming portions Pa to Pd. The toner images formed on the photosensitive drums 1*a* to 1*d* are primarily transferred sequentially onto the intermediate transfer belt 8, which moves in contact with the photosensitive drums 1*a* to 1*d*, and the toner images are superimposed one on another on the intermediate transfer belt 8. Then, the toner images primarily transferred onto the intermediate transfer belt 8 are secondarily transferred onto a sheet S, as an example of recording medium, by operation of a secondary transfer roller 9. The sheet S onto which the toner images have been secondarily transferred is discharged to outside the image forming apparatus 100 after the toner images are fixed on the sheet S at a fixing device 15. An image forming process is performed on each of the photosensitive drums 1*a* to 1*d* while making the photosensitive drums 1*a* to 1*d* rotate in a clockwise direction in FIG. 1.

Sheets S onto each of which a toner image is to be transferred are stored in a feeder 16 disposed in a lower part of the main body of the image forming apparatus 100. A sheet S is conveyed via a sheet feeding roller 12 and a registration roller pair 13 to a nip portion between the secondary transfer roller 9 and a later-described drive roller 11 provided for driving the intermediate transfer belt 8. The intermediate transfer belt 8 is made of a dielectric resin sheet, and mainly formed as a (seamless) belt having no seam. Furthermore, for the purpose of removing toner and the like remaining on a surface of the intermediate transfer belt 8, a blade-shaped belt cleaner 19 is disposed on a downstream side of the secondary transfer roller 9.

An image reader 22 is constituted by a scanning optical system, a condenser lens, a CCD sensor, and the like (none of which is illustrated), and the image reader 22 reads a document image to convert the document image into image data. The scanning optical system incorporates a scanner lamp, which illuminates a document for copying, and a mirror, which changes the optical path of light reflected from a document. The condenser lens collects light reflected from a document to form an image. The CCD sensor converts the formed image into electric signals.

Next, the image forming portions Pa to Pd will be described. Provided around and below the rotatably disposed photosensitive drums 1*a*, 1*b*, 1*c*, and 1*d* are chargers 2*a*, 2*b*, 2*c*, and 2*d* that charge the photosensitive drums 1*a*, 1*b*, 1*c*, and 1*d*, respectively, an exposure device 5 that exposes the photosensitive drums 1*a* to 1*d* with light based on image information, developing devices 3*a*, 3*b*, 3*c*, and 3*d* that form a toner image on the photosensitive drums 1*a*, 1*b*, 1*c*, and 1*d*, respectively, and cleaning portions 7*a*, 7*b*, 7*c*, and 7*d* that remove residual developer (toner) and the like remaining on the photosensitive drums 1*a*, 1*b*, 1*c*, and 1*d*, respectively.

In a copying operation, the image reader 22 reads image data of a document and converts the image data into an image signal. The charging devices 2*a* to 2*d* uniformly charge surfaces of the photosensitive drums 1*a* to 1*d*. Then, the exposure device 5 irradiates the photosensitive drums 1*a* to 1*d* with light according to the image data, and thereby an electrostatic latent image is formed on each of the photosensitive drums 1*a* to 1*d* according to the image data. The developing devices 3*a* to 3*d* are each filled with a predetermined amount of two-component developer containing cyan, magenta, yellow, or black toner. Note that, the developing devices 3*a* to 3*d* are replenished with toner from toner containers 4*a* to 4*d* when the proportion of toner contained in the two-component developer in each of the developing devices 3*a* to 3*d* falls below a required value after later-described toner image formation. The toner contained in the developer in each of the developing devices 3*a* to 3*d* is supplied therefrom, and electrostatically adheres, onto a corresponding one of the photosensitive drums 1*a* to 1*d*. Thereby, a toner image is formed on each of the photosensitive drums 1*a* to 1*d* corresponding to the electrostatic latent image formed by the exposure from the exposure device 5.

Then, a predetermined transfer voltage is applied to primary transfer rollers 6*a* to 6*d* to thereby primarily transfer yellow, cyan, magenta, and black toner images formed on the photosensitive drums 1*a* to 1*d* onto the intermediate transfer belt 8. Residual toner and the like left on the surface of each of the photosensitive drums 1*a*, 1*b*, 1*c*, and 1*d* is removed by the cleaning portions 7*a*, 7*b*, 7*c*, and 7*d*, respectively.

The intermediate transfer belt 8 is wound around and between a tension roller 10 and the drive roller 11, which are located on an upstream side and a downstream side, respectively. When the intermediate transfer belt 8 starts to rotate in the counterclockwise direction along with rotation of the drive roller 11 caused by a driving motor (unillustrated), a sheet S is conveyed from the registration roller pair 12*b* at a predetermined timing to a nip portion (a secondary transfer nip portion) between the drive roller 11 and the secondary transfer roller 9 provided adjacent to the drive roller 11. Then, a full color image on the intermediate transfer belt 8 is secondarily transferred onto the sheet S. The sheet S onto which the toner image has been transferred is conveyed through a sheet conveyance path 14 to the fixing device 15.

The sheet S, which has been conveyed to the fixing device 15, is heated and pressurized by a fixing roller pair 15*a*, whereby the toner image is fixed on a surface of the sheet S, and a predetermined full-color image is formed. The sheet S on which the full-color image has been formed is directed toward one of a plurality of conveying directions branched from a branch portion 17. When forming an image only on one side of the sheet S, the sheet S is discharged as it is by a discharge roller pair 18 onto a delivery tray 20.

Figure 2:
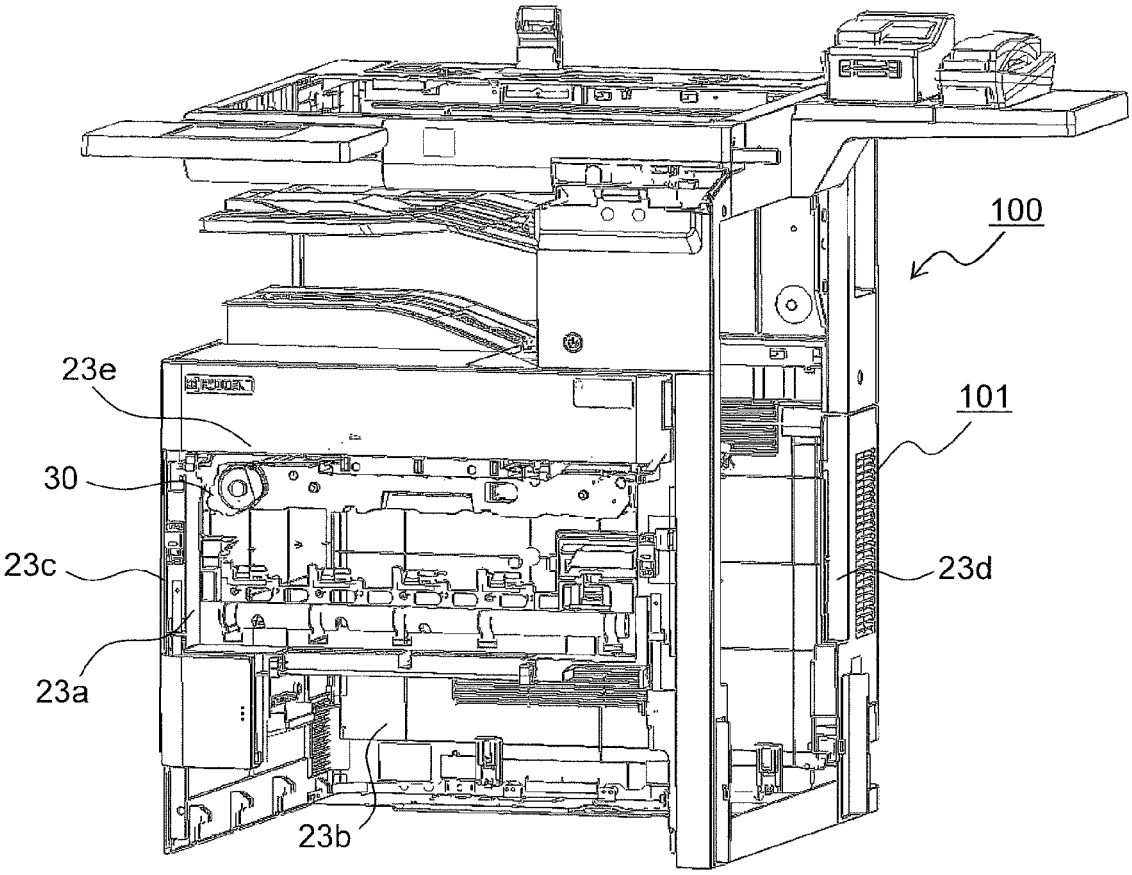
FIG. 2 is a perspective view illustrating an intermediate transfer unit in a state of being inserted in a main body frame of the image forming apparatus.
Figure 3:
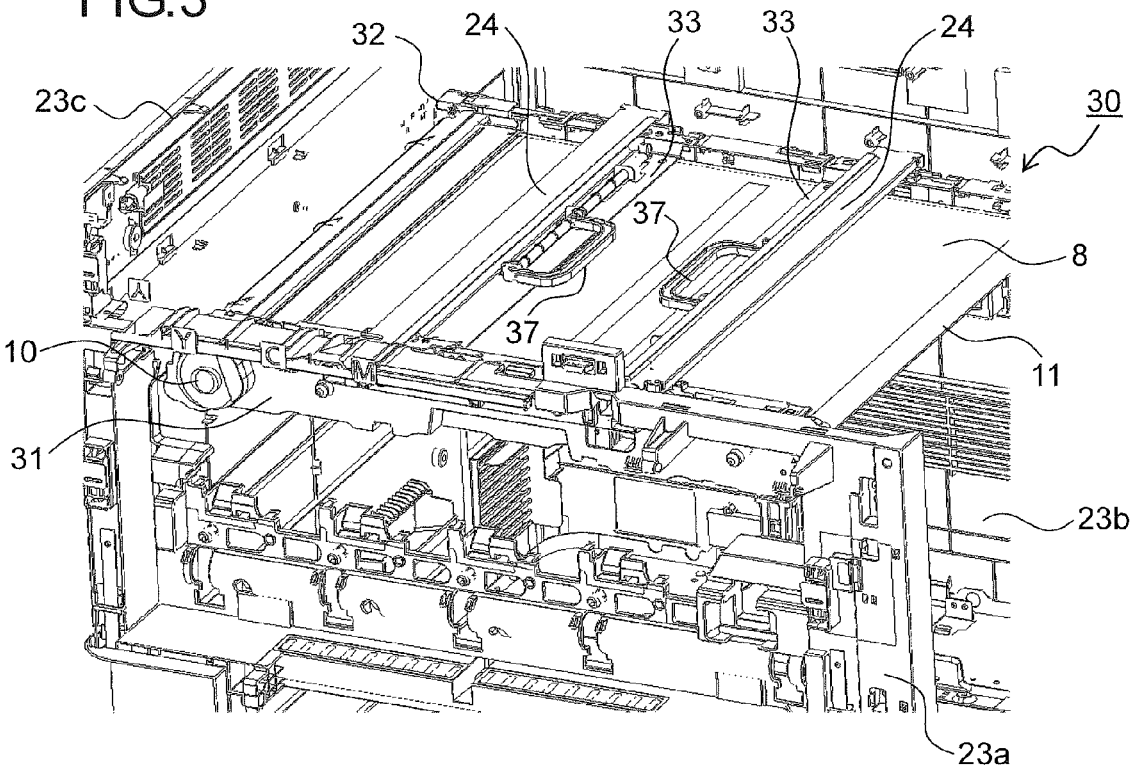
FIG. 3 is a perspective view of the intermediate transfer unit inserted in the main body frame, as viewed from above.

FIG. 2 is a perspective view illustrating a state in which an intermediate transfer unit 30 is inserted in a main body frame 101 of the image forming apparatus 100 illustrated in FIG. 1. FIG. 3 is a perspective view of the intermediate transfer unit 30 inserted in the main body frame 101, as viewed from above. Such elements in FIGS. 2 and 3 having counterparts in FIG. 1 are given the same reference signs as their counterparts, and descriptions thereof will be omitted.

As illustrated in FIG. 2, the main body frame 101 includes a front face frame 23*a* and a rear face frame 23*b*, a pair of side panel frames 23*c* and 23*d*, which are arranged opposite from each other, and an upper face frame 23*e*, which is arranged above the front face frame 23*a*, the rear face frame 23*b*, and the side panel frames 23*c* and 23*d*. Note that the upper face frame 23*e* is not illustrated in FIG. 3, but only rail guides 24 provided on the upper face frame 23*e* are illustrated.

As illustrated in FIG. 3, the intermediate transfer unit 30 includes components such as a pair of side covers 31 and 32, two connecting frames 33, which are fixed to the side covers 31 and 32 so as to extend like bridges between the side covers 31 and 32, a plurality of suspension rollers including the drive roller 11 and the tension roller 10, which are supported between the side covers 31 and 32, and the intermediate transfer belt 8, which is endless-shaped and stretched between these suspension rollers. The connecting frames 33 are each provided with a grip member 37 for carrying the intermediate transfer unit 30.

The connecting frames 33 are further provided with rail portions (unillustrated) which engage with the rail guides 24 provided on a lower surface of the upper face frame 23*e*. By inserting the rail portions along the rail guides 24, the intermediate transfer unit 30 is supported to be slidable with respect to the upper face frame 23*e*.

Figure 4:
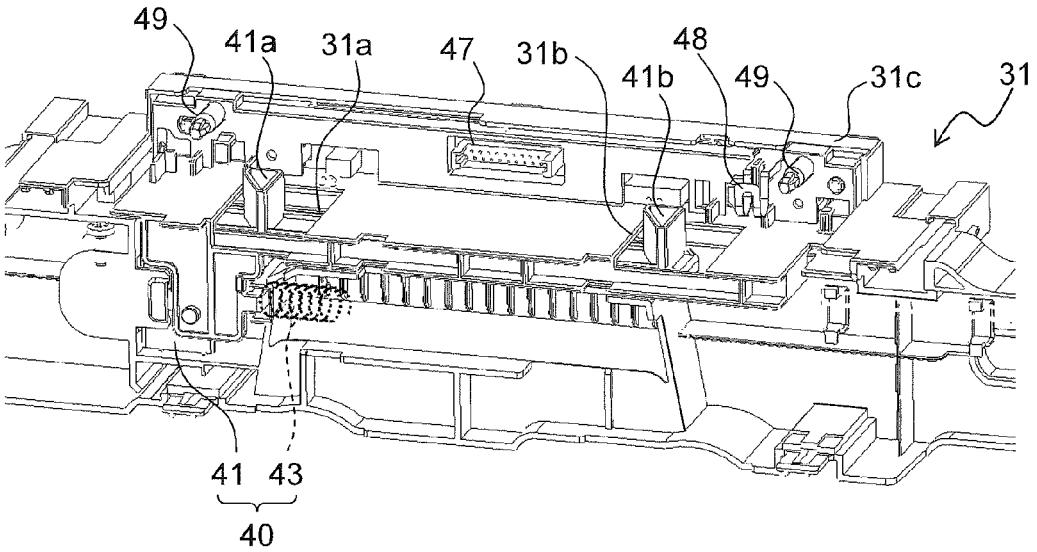
FIG. 4 is a partial enlarged view illustrating a substantially central part of a side cover arranged at a drawing-side end part of the intermediate transfer unit, as seen from inside.
Figure 5:
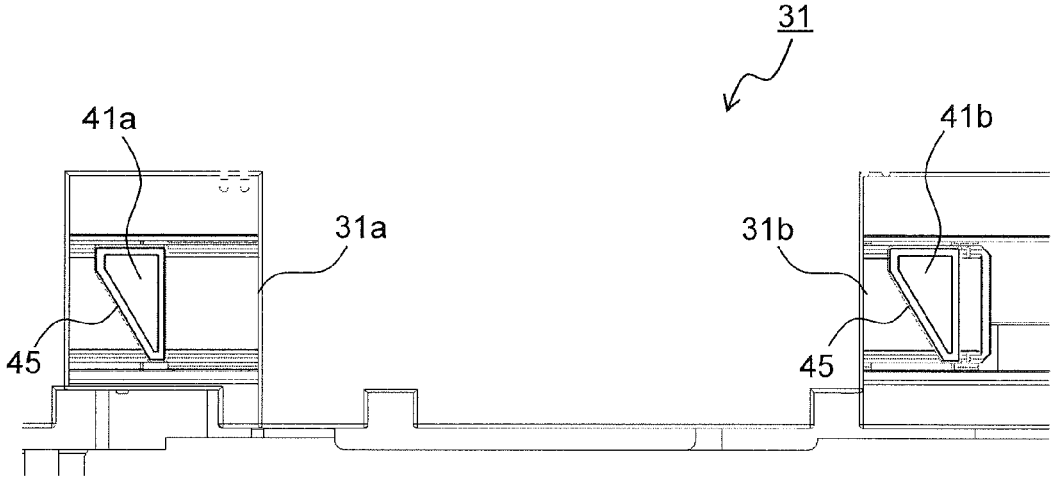
FIG. 5 is a plan view of an area around engagement projections of a lock member arranged inside the side cover, as seen from above.
Figure 6:
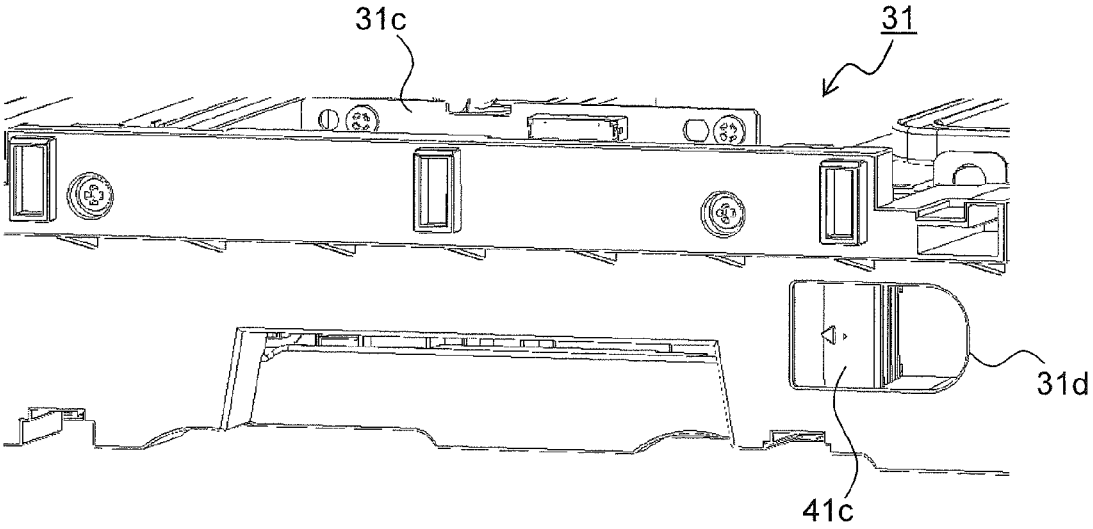
FIG. 6 is a partial enlarged view illustrating the substantially central part of the side cover, as seen from outside.

FIG. 4 is a partial enlarged view of a substantially central part of the side cover 31 in its longitudinal direction, as seen from inside, the side cover 31 being arranged at a drawing-side end part (the near side in the sheet on which FIG. 3 is drawn) of the intermediate transfer unit 30 illustrated in FIG. 3. FIG. 5 is a plan view of an area around engagement projections 41*a* and 41*b* of a lock member 41, as seen from above, the lock member 41 being arranged in the side cover 31. FIG. 6 is a partial enlarged view illustrating the substantially central part of the side cover 31 in its longitudinal direction, as seen from outside. A detailed description will be given of the intermediate transfer unit 30 with reference to FIG. 4 to FIG. 6.

As illustrated in FIG. 4, the side cover 31 is provided with a lock mechanism 40, which holds the intermediate transfer unit 30 in a state of being mounted in the main body frame 101, and is able to release the hold of the intermediate transfer unit 30. The lock mechanism 40 includes the lock member 41, which is provided to be slidable along the longitudinal direction (a left-right direction in FIG. 4) of the side cover 31, and a compression spring 43, which biases the lock member 41 in one direction (a leftward direction in FIG. 4).

On an upper surface of the lock member 41, the engagement projections 41*a* and 41*b* are formed which each engage with a corresponding one of engaged portions 50 (see FIG. 7) of the main body frame 101. The engagement projections 41*a* and 41*b* project through openings 31*a* and 31*b*, respectively, which are formed in an upper surface of the side cover 31. As illustrated in FIG. 5, in each of the engagement projections 41*a* and 41*b*, there is formed an inclined surface 45, which is inclined in a direction (a left-right direction in FIG. 5) perpendicular to an inserting direction of the intermediate transfer unit 30.

Further, on a side surface of the lock member 41 on an upstream side with respect to the inserting direction of the intermediate transfer unit 30, there is formed a switching portion 41*c* (see FIG. 6) for moving the lock member 41 in a direction reverse to the biasing direction of the compression spring 43. As illustrated in FIG. 6, the switching portion 41*c* is exposed via an operation window 31*d*, which is formed in an outer side surface (on the near side in the sheet on which FIG. 3 is drawn) of the side cover 31. Here, the switching portion 41*c* is a pressed portion (operated portion) which is made to reciprocate to switch a state of the lock member 41. The shape of the switching portion 41*c* is not limited to the shape in the present embodiment, but it may have, for example, a lever shape or a handle shape.

In the upper surface of the side cover 31, on an upstream side (the far side in the sheet on which FIG. 4 is drawn) of the engagement projections 41*a* and 41*b* with respect to the inserting direction of the intermediate transfer unit 30, there is formed an upstanding wall portion 31*c*. On an inner surface of the upstanding wall portion 31*c*, there are provided a unit-side connector 47, a grounding spring 48, and two positioning pins 49. The unit-side connector 47 is connected to a main-body-side connector 46 (see FIG. 11), which is provided in the main body frame 101. The grounding spring 48 contacts the main body frame 101, which is made of metal, and thereby the intermediate transfer unit 30 is grounded (earthed). The positioning pins 49 are inserted into positioning holes (unillustrated) provided in the main body frame 101 for positioning of the intermediate transfer unit 30 with respect to the main body frame 101.

Figure 7:
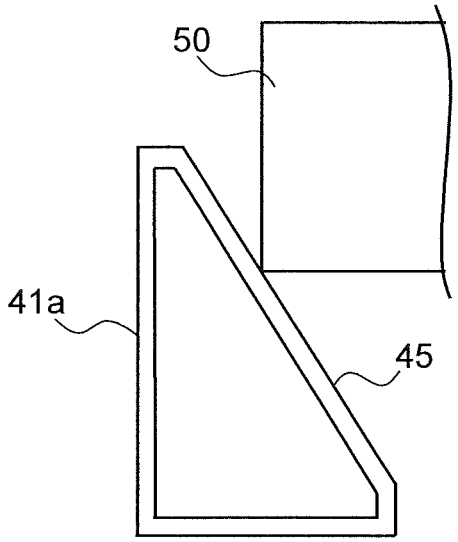
FIG. 7 is a diagram illustrating a state in which an inclined surface of an engagement projection has come into contact with an engaged portion along with insertion of the intermediate transfer unit.
Figure 8:
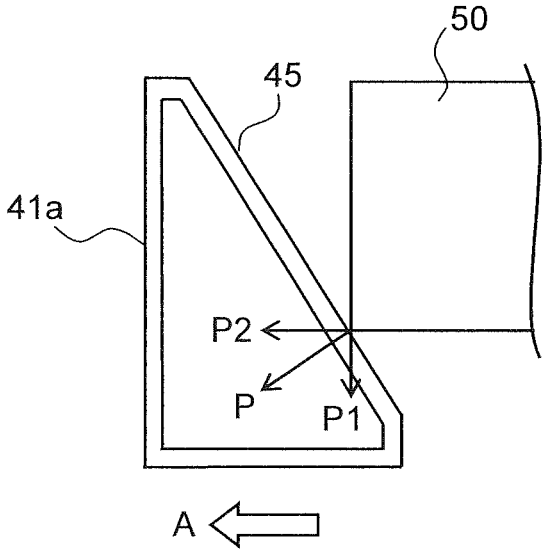
FIG. 8 is a diagram illustrating a state in which the engagement projection moves in a direction indicated by an arrow A on receiving reaction from the engaged portion along with further insertion of the intermediate transfer unit from the state illustrated in FIG. 7.
Figure 9:
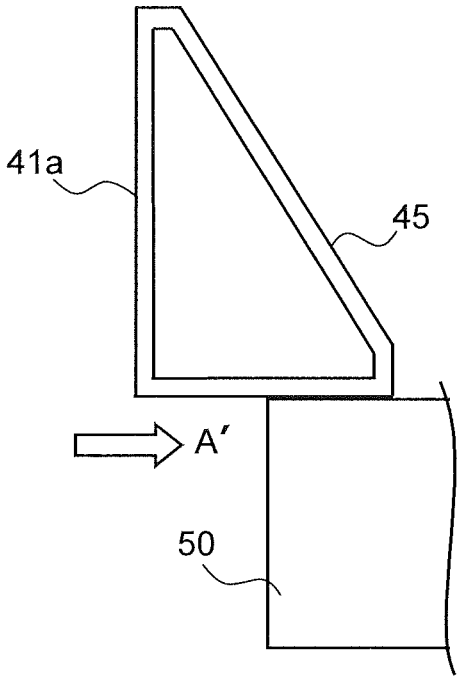
FIG. 9 is a diagram illustrating a state in which the engagement projection has come into engagement with the engaged portion when the intermediate transfer unit is further inserted from the state illustrated in FIG. 8.
Figure 10:
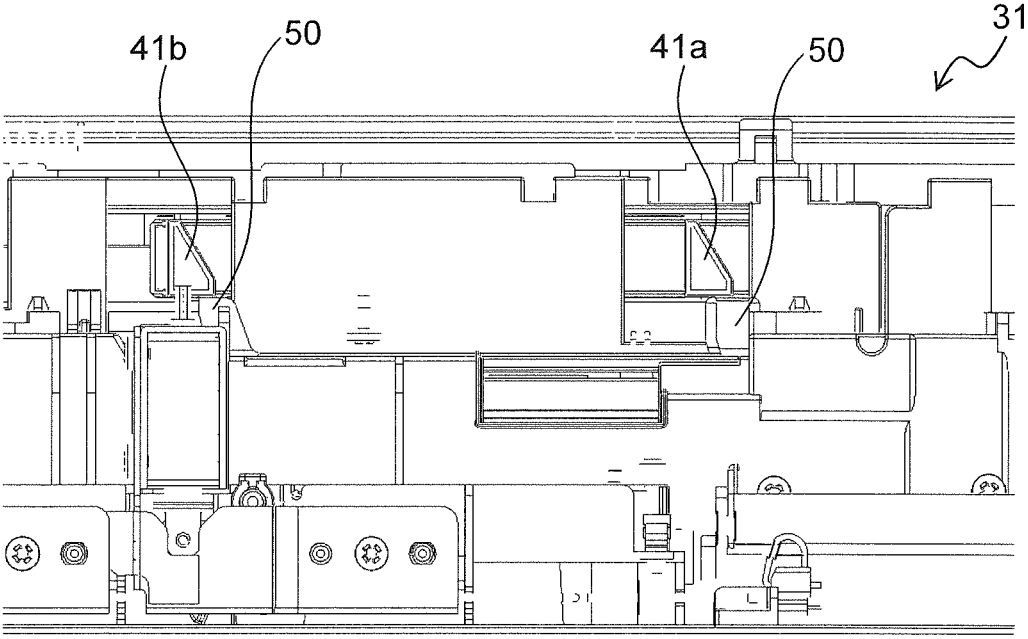
FIG. 10 is a partial plan view of the intermediate transfer unit, illustrating a state in which engagement projections are engaged with engaged portions.
Figure 11:
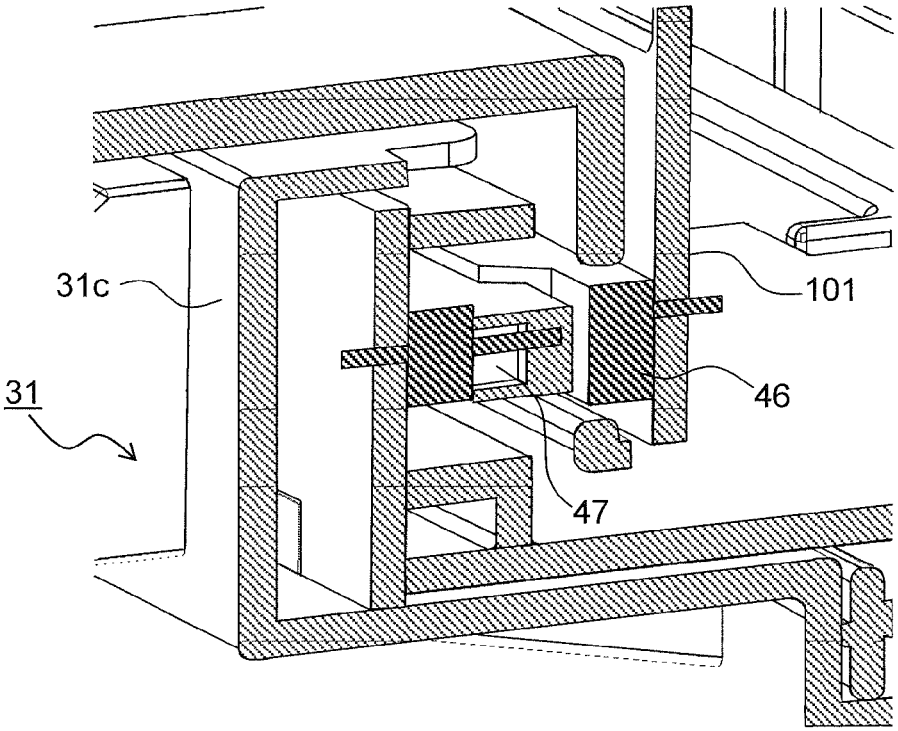
FIG. 11 is a sectional view of the vicinity of a unit-side connector of the intermediate transfer unit inserted in the main body frame.

Next, a description will be given of an operation of inserting the intermediate transfer unit 30 into the main body frame 101. FIG. 7 to FIG. 9 are diagrams illustrating a mechanism how the engagement projection 41*a* and a corresponding one of the engaged portions 50 come into engagement with each other along with the insertion of the intermediate transfer unit 30, FIG. 10 is a partial plan view of the intermediate transfer unit 30, illustrating a state in which the engagement projections 41*a* and 41*b* are engaged with the engaged portions 50, and FIG. 11 is a sectional view of an area in the vicinity of the unit-side connector 47 of the intermediate transfer unit 30 inserted in the main body frame 101. Although a description will be omitted herein, the engagement projection 41*b* also engages with a corresponding one of the engaged portions 50 in the same mechanism illustrated in FIG. 7 to FIG. 9.

To insert the intermediate transfer unit 30 into the main body frame 101, the intermediate transfer unit 30 is inserted along the rail guides 24 (see FIG. 3), with the side cover 32 in the lead. When the intermediate transfer unit 30 is inserted to a predetermined position, as illustrated in FIG. 7, the inclined surface 45 of the engagement projection 41*a* projecting from the upper surface of the side cover 31 comes into contact with the engaged portion 50 of the main body frame 101.

When the intermediate transfer unit 30 is further inserted from the state illustrated in FIG. 7, the inclined surface 45 receives drag force P from the engaged portion 50 due to reaction as illustrated in FIG. 8. At this time, the inclination of the inclined surface 45 causes the drag force P to be divided into a force component P1 in a direction toward an upstream side in the inserting direction and a force component P2 in a direction perpendicular to the inserting direction. Since the lock member 41 is supported to be slidable in the direction (the longitudinal direction of the side cover 31) which is perpendicular to the inserting direction, the lock member 41 is caused by the force component P2 to slide in a direction indicated by an arrow A against the biasing force of the compression spring 43 (see FIG. 4).

Then, when the lock member 41 slides until the engaged portion 50 leaves the inclined surface 45, action of the force component P2 is lost. Thus, as illustrated in FIG. 9, the biasing force of the compression spring 43 causes the lock member 41 to slide in a direction indicated by an arrow A', and the engagement projection 41*a* and the engaged portion 50 engage with each other. Thereby, as illustrated in FIG. 10, an engagement state is achieved in which the engagement projections 41*a* and 41*b* each overlap with the corresponding one of the engaged portions 50 in an inserting/drawing direction of the intermediate transfer unit 30 (an up-down direction in FIG. 10), to restrict the drawing of the intermediate transfer unit 30.

At this time, the positioning pins 49 provided on the side cover 31 are inserted into the positioning holes (unillustrated) formed in the main body frame 101, and, as illustrated in FIG. 11, the unit-side connector 47 is connected to the main-body-side connector 46. Further, the grounding spring 48 comes into contact with the main body frame 101, and thereby the intermediate transfer unit 30 is grounded. Further, a unit-side coupling (unillustrated) fixed to one end of a rotation shaft of the drive roller 11 is coupled to a drive output coupling (unillustrated) of the main body of the image forming apparatus 100 to make it possible to input driving force to the drive roller 11. In this manner, mounting of the intermediate transfer unit 30 with respect to the main body frame 101 is completed.

Figure 12:
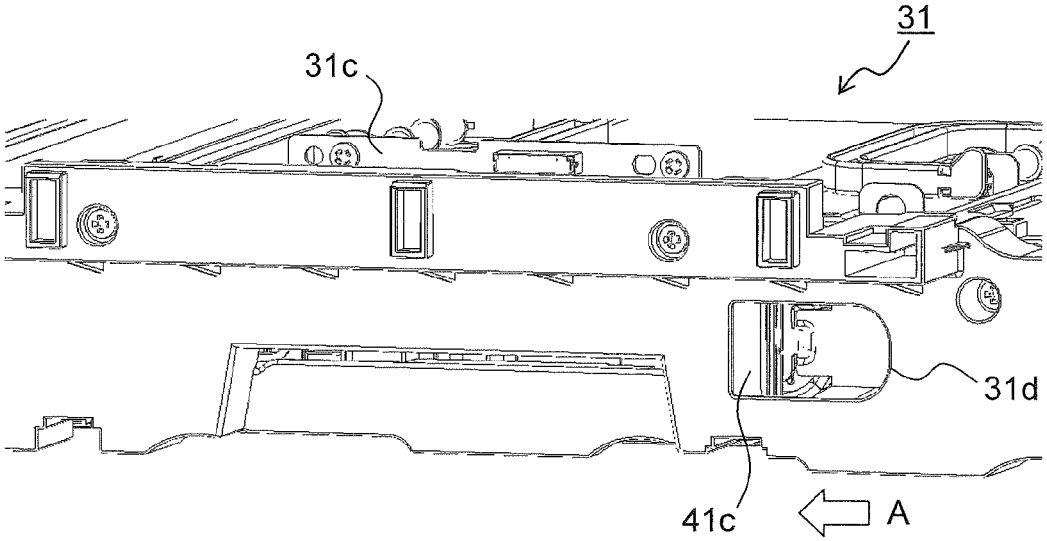
FIG. 12 is a partial enlarged view illustrating a state after a switching portion in the state illustrated in FIG. 6 has been operated.
Figure 13:
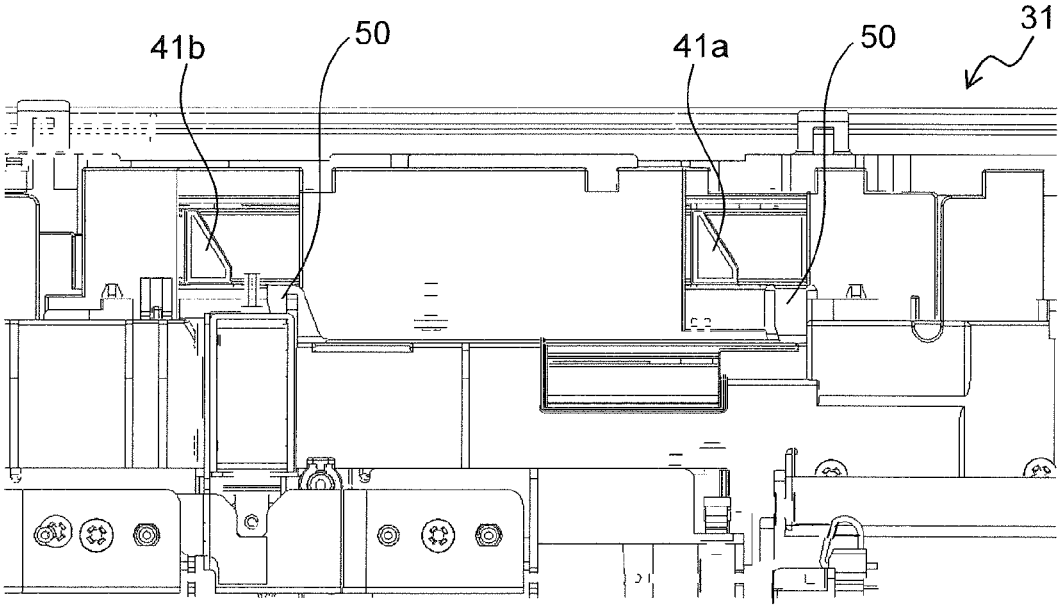
FIG. 13 is a partial plan view of the intermediate transfer unit, illustrating a state after the engagement between the engagement projection and the engaged portion is released.

Next, a description will be given of an operation of drawing the intermediate transfer unit 30 out of the main body frame 101. FIG. 12 is a partial enlarged view of the side cover 31, illustrating a state after the switching portion 41*c* in the state illustrated in FIG. 6 has been operated. FIG. 13 is a partial plan view of the intermediate transfer unit 30 in a state after the engagement between the projections 41*a* and 41*b* with the engaged portions 50 has been released.

To draw the intermediate transfer unit 30 out of the main body frame 101, a user grips the switching portion 41*c*, which is exposed through the operation window 31*d* of the side cover 31, to slide the lock member 41 in the direction indicated by the arrow A against the biasing force of the compression spring 43, as illustrated in FIG. 12. Thereby, as illustrated in FIG. 13, the engagement projections 41*a* and 41*b* are brought out of engagement with the engaged portions 50 into an engagement-released state in which the engagement projections 41*a* and 41*b* do not overlap with the engaged portions 50 in the inserting/drawing direction of the intermediate transfer unit 30 (the up-down direction in FIG. 13), and it becomes possible to draw the intermediate transfer unit 30 out of the main body frame 101.

Then, the user, gripping the switching portion 41*c*, pulls the intermediate transfer unit 30 frontward along the rail guides 24 of the image forming apparatus 100, and thereby the drawing out of the intermediate transfer unit 30 is completed.

According to this configuration, in mounting the intermediate transfer unit 30 in the image forming apparatus 100, the engagement projections 41*a* and 41*b* of the lock member 41 come into engagement with the engaged portions 50 of the main body frame 101 only with the operation of inserting the intermediate transfer unit 30. Further, in detaching the intermediate transfer unit 30 from the image forming apparatus 100, the engagement of the engagement projections 41*a* and 41*b* with the engaged portions 50 can be released just by gripping the switching portion 41*c*.

Thus, through a simple operation without fastening a screw, operating a rotary lever, or the like, the user can have the intermediate transfer unit 30 securely held in the main body frame 101 and release the hold of the intermediate transfer unit 30. As a result, the user can perform a smooth operation of replacing the intermediate transfer unit 30.

It should be understood that the present disclosure is not limited to the above embodiments, and various modifications are possible within the scope of the present disclosure. For example, in the embodiment described above, the intermediate transfer unit 30 is inserted or drawn in a direction (a direction perpendicular to a surface of the sheet on which FIG. 1 is drawn) parallel to a drive shaft, but the intermediate transfer unit 30 may be inserted and drawn out in a direction (a left-right direction in FIG. 1) perpendicular to the drive shaft. Further, the present disclosure is applicable to any unit besides the intermediate transfer unit 30, as long as it is a unit that is horizontally inserted into, and drawn out of, the main body of the image forming apparatus 100.

Further, in the above-described embodiment, when the intermediate transfer unit 30 is inserted into the main body frame 101, the engagement projections 41*a* and 41*b* are moved by using the inclined surfaces 45, which are formed in the engagement projections 41*a* and 41*b*, but the inclined surfaces 45 may be formed on the engaged portions 50.

Further, application of the present disclosure is not limited to tandem color printers dealt with in the above embodiment, but the present disclosure is applicable to any image forming apparatus, such as a facsimile machine and a laser printer, which is provided with a unit that is horizontally drawn out, and inserted into, the main body of the image forming apparatus.

The present disclosure can be used in an image forming apparatus provided with a unit horizontally detachable and attachable with respect to the apparatus main body. By using the present disclosure, it is possible to provide an image forming apparatus capable of, with a simple device, both locking and unlocking a unit horizontally detachable and attachable with respect to an apparatus main body to and from the apparatus main body.

What is claimed is:

1. An image forming apparatus, comprising:

a main body frame;

a unit which is horizontally insertable and drawable with respect to the main body frame; and a lock mechanism which holds the unit in a state of being mounted in the main body frame, and is able to release hold of the unit, wherein the lock mechanism includes a lock member which is arranged in the unit to be reciprocatable in a direction perpendicular to an inserting/drawing direction of the unit, the lock member having an engagement projection engageable with an engaged portion formed in the main body frame, and a biasing member which biases the lock member in a first direction toward engagement of the engagement projection with the engaged portion, along with insertion of the unit into the main body frame, the lock member moves in a second direction reverse to the first direction against biasing force of the biasing member, and when the unit is inserted to a predetermined position, the lock member is moved by the biasing force of the biasing member in the first direction and the engagement projection engages with the engaged portion, and by moving the lock member in the second direction against the biasing force of the biasing member, engagement between the engagement projection and the engaged portion is released to make it possible to draw the unit out of the main body frame.

2. The image forming apparatus according to claim 1, wherein in at least one of the engagement projection and the engaged portion, an inclined surface inclined in a moving direction of the lock mechanism is formed at a part which comes into contact with the engaged portion or the engagement projection when the unit is inserted into the main body frame.

3. The image forming apparatus according to claim 1, wherein in the lock member, a switching portion is formed which is gripped in moving the lock member in the second direction.

4. The image forming apparatus according to claim 1, wherein the unit is provided with a unit-side connector which is connected to a main-body-side connector provided in the main body frame, and in a state in which the engagement projection is engaged with the engaged portion, connection between the unit-side connector and the main-body-side connector is completed.

5. The image forming apparatus according to claim 1, wherein the unit is provided with a grounding spring which grounds the unit by contacting the main body frame, and in a state in which the engagement projection is in engagement with the engaged portion, the grounding spring contacts the main body frame to ground the unit.

6. The image forming apparatus according to claim 1, wherein the unit is an intermediate transfer unit including an endless-shaped intermediate transfer belt onto which toner images to be transferred onto a recording medium are sequentially transferred to be laid one on another, and a plurality of suspension rollers which stretch the intermediate transfer belt therebetween.

7. The image forming apparatus according to claim 6, wherein the intermediate transfer unit has a pair of side covers supporting both axial-direction ends of each of the suspension rollers, and the intermediate transfer unit being insertable and drawable with respect to the main body frame horizontally along an axial direction of the suspension rollers, and the lock member is arranged in one of the side covers that is disposed on an upstream side in an inserting direction of the intermediate transfer unit.

* * * * *